US005623734A

United States Patent [19]

Pugliatti

[11] Patent Number: 5,623,734

[45] Date of Patent: Apr. 29, 1997

[54] PEDICURE SOCK

[76] Inventor: Annette M. Pugliatti, 30 Ridgeland Terr., Rye, N.Y. 10580

[21] Appl. No.: 408,321

[22] Filed: Mar. 21, 1995

[51] Int. Cl.[6] ..... A43B 7/00; A41B 11/08

[52] U.S. Cl. ..... 2/239; 36/94; D2/980; 2/61; 132/73

[58] Field of Search ..... 2/239, 241, 242, 2/61, 21; D28/56; 132/73, 285; D2/980, 901; 602/63, 65, 66; 66/178 R, 183, 184, 185, 186, 178 A, 189; 36/94

[56] References Cited

U.S. PATENT DOCUMENTS

| | | | |
|---|---|---|---|
| D. 260,047 | 8/1981 | Heinz . | |
| D. 271,156 | 11/1983 | Williamson . | |
| D. 343,947 | 2/1994 | Coito et al. . | |
| D. 345,045 | 3/1994 | Atkins et al. . | |
| 715,543 | 12/1902 | Bosworth . | |
| 1,308,483 | 7/1919 | Craighead . | |
| 1,518,758 | 12/1924 | Rodee | 602/65 X |
| 1,798,201 | 3/1931 | Hedges . | |
| 1,999,929 | 4/1935 | Hearn . | |
| 2,327,836 | 8/1943 | Willard | 132/73 X |
| 2,335,320 | 11/1943 | Swietek | 132/73 |
| 2,506,308 | 5/1950 | Maynier | 132/73 |
| 2,725,570 | 12/1955 | Penna | 2/163 |
| 2,751,693 | 6/1956 | Baker | 132/73 |
| 3,128,763 | 4/1964 | Langenfeld et al. | 2/239 X |
| 3,329,972 | 7/1967 | Schwab et al. . | |
| 3,863,272 | 2/1975 | Gville | 2/239 |
| 3,967,390 | 7/1976 | Anfruns | 2/239 X |
| 4,017,987 | 4/1977 | Perez, Jr. et al. . | |
| 4,181,982 | 1/1980 | Segovia . | |
| 4,207,880 | 6/1980 | Zinkovich . | |
| 4,644,669 | 2/1987 | Greco . | |
| 4,852,272 | 8/1989 | Chilewich et al | 2/239 X |
| 4,907,297 | 3/1990 | Gallucci | 2/163 |
| 5,054,129 | 10/1991 | Baehr . | |
| 5,140,709 | 8/1992 | Cohn et al. | 2/163 |
| 5,186,189 | 2/1993 | Harris | 2/21 X |

FOREIGN PATENT DOCUMENTS

| | | |
|---|---|---|
| 451979 | 10/1948 | Canada . |
| 472084 | 7/1914 | France . |
| 1176074 | 4/1959 | France . |
| 599494 | 7/1934 | Germany . |
| 256032 | 12/1927 | Italy . |

*Primary Examiner*—C. D. Crowder
*Assistant Examiner*—Shirva L. Jenkins
*Attorney, Agent, or Firm*—Jordan and Hamburg

[57] ABSTRACT

A pedicure sock for keeping a foot warm during a pedicure. The pedicure sock having individual stalls for the toes which are truncated to leave the toe nails exposed. The stalls serving to separate the tops of the toes, where the toe nails are located, such that a pedicure can be easily performed and the fresh polish on the toe nails can dry without interference from adjacent toes and toe nails.

26 Claims, 2 Drawing Sheets

PEDICURE SOCK

BACKGROUND OF THE INVENTION

The present invention relates to a pedicure sock for allowing a user to keep his/her feet warm while toe nails are being polished and while they are drying and, at the same time, keep the toe nails separated so that the polish is not marred while it is drying.

Generally, devices which are worn on the feet during or after a pedicure do not try to keep the feet warm. Some pedicure devices do try and keep the toes separated. However, most simply aim to provide an artificial sole on which to walk while the toe nails are drying.

Pedicure sandals which try to keep the toes separated include Zinkovich, U.S. Pat. No. 4,207,880, Heinz, U.S. Pat. No. Des. 260,047, Williamson, U.S. Pat. No. Des. 271,156 and Perez, U.S. Pat. No. 4,017,987.

Other pedicure sandals may only separate the big toe from the rest of the toes, such as Coito, U.S. Pat. No. Des. 343,947.

Still other types of pedicure sandals do not separate the toes at all. Sandals, such as Greco, U.S. Pat. No. 4,644,669 and Atkins, U.S. Pat. No. Des. 345,045, are ones which do not separate the toes at all.

A principal drawback to the above described pedicure devices is that none offers the ability to keep the user's foot warm to allow the user to walk outside in cold weather, or, even, to allow the user to be comfortable in a pedicure salon during the winter months when exposed feet are likely to be cold. It is undesirable to place freshly manicured toe nails into a sock or a shoe, since the fresh polish is likely to be marred and the sock or shoe may be stained or coated by the polish requiring the use of solvents to remove the polish from the shoe or the sock, risking ruining the shoe or sock by application of the solvent.

In view of the above, it would be preferable that the toe nails are not covered by the sock used to keep them warm. However, there are no socks of this type which have been used or, indeed, could be advantageously used as a pedicure device. Segovia, U.S. Pat. No. 4,181,982, shows a stocking with a convertible toe opening so that the toes can be left exposed. Additionally, Schwab, U.S. Pat. No. 3,329,972, shows an infant's bootie which has a convertible toe construction allowing the toes to be exposed. Four out of five toes are exposed in the stocking or sock of FIG. 2 of German Patent No. 599,494. Additionally, four out of five toe nails are exposed in the strip of material encircling the front part of the foot in Italian Patent No. 256,032. The primary drawback of these socks or stockings is that they do not separate the toe nails such that, if one were to use these socks or stockings as a pedicure device, the polish on the toe nails could be marred by adjacent toes or toe nails, and polish could rub off on the skin of the toes requiring the use of solvent to remove the polish. Additionally, the solvent could get on one of the toe nails, thus, further marring the polish. Another problem in the Italian and German patents referred to is that the little toe remains covered. Thus, the socks or stockings in the German or Italian reference have an additional drawback which makes them unsuitable for use as a pedicure device; the little toe cannot be subjected to pedicure treatment while the sock or stocking is worn.

Other socks or stockings may separate the toes, but keep them covered and, thus, are unacceptable as pedicure devices, since they offer the same problems for freshly painted toe nails as do conventional socks or shoes. Patents on this type of sock or stocking include Craighead, U.S. Pat. No. 1,308,483, Bosworth, U.S. Pat. No. 715,543, Lesiuk, French Patent No. 1,176,074 and Lambert, French Patent No. 472,084.

Hedges, U.S. Pat. No. 1,798,201 refers to using socks or stockings which separate the five toes and enclose three out of the five toes. Two of the five toes are left uncovered so that there is less material between the toes to avoid excessive chafing. However, the Hedges sock or stocking offers the same problems when used as a pedicure device as do stockings or socks which enclose all of the toes.

Baehr, U.S. Pat. No. 5,054,129, refers to a garment which exposes the toes and may separate the smallest toe and the largest toe from the other toes. It is unsuitable as a pedicure device because it does not separate each toe one from the other, and because its manner of separation only serves to divide the toes at their respective bases such that the tops of the toes, where the toenails are located, are not separated one from the other. Thus, the fresh polish applied during the pedicure can be easily marred by adjacent toes or toe nails.

German Patent No. 599,494 refers to a sock or stocking having an open slit on top of the toe nail of each of the four larger toes in FIG. 15. However, it does not appear that the toes can fit through these slits. Clearly, the slits are to remain on top of the toe nails, since the garment in FIG. 15 is shown with the toes already inside. Even if the slits were large enough for the toes to fit through, the German Patent does not offer a way to prevent the garment material from stretching out and covering over at least a portion of the toe nail after it has been pulled down beneath the toe nail, thus, risking damage both to the polish and the garment. Additionally, the smallest toe could not be polished, since a slit is not even shown on top of the smallest toe.

Canadian Patent No. 451,979 refers to hosiery in which the toes are exposed and each toe is separately encircled by the hosiery at the base of the toe for dividing each toe one from the other. However, since the division between the toes occurs at the base of the toes, the tops of the toes where the toe nails are located are not separated such that fresh polish may be easily marred by adjacent toes and/or toe nails.

Hearn, U.S. Pat. No. 1,999,929, refers to hosiery with strips or straps between each toe. However, the strips between the toes in Hearn only serve to divide the toes at the base of each toe, such that the tops of each toe, where the toe nail is located, would be in contact with each other. When the tops of the toes are in contact with each other, fresh polish can easily be marred by adjacent toes and/or toe nails.

None of the pedicure devices or hosiery discussed above serve to separate the tops of the toes, where the toe nails are located, to protect fresh polish on the toe nails and, at the same time, provide a covering to keep the foot warm.

SUMMARY OF THE INVENTION

It is an object of the present invention to overcome the drawbacks of the prior art.

It is a further object of the present invention to provide a pedicure device which can separate the tops of the toes, where the toe nails are located, to avoid damage to fresh polish and to make it easier to perform a pedicure.

It is a still further object of the present invention to provide a pedicure device which can be worn during and/or after a pedicure to keep the user's foot warm.

It is yet a still further object of the present invention to provide a pedicure device which allows access to a user's toe nails during a pedicure.

It is a still further object of the present invention to provide a pedicure device which is capable of keeping the user's foot warm and keeping the user's toes separated at the top where the toe nails are located to prevent damage to the polish applied during a pedicure until the polish is completely dry and/or cured.

The present invention is a pedicure sock for wearing before, during and/or after a pedicure. The sock is substantially tubular shaped and has separate stalls for each toe, like sleeves for each toe, which terminate below the nail and above the base of each toe, where the toes are connected to each other, to prevent the tops of each toe, where the toe nails are located, from contacting each other.

The above and other objects, features and advantages of the invention will become readily apparent from the following detailed description thereof which is to be read in connection with the accompanying drawings.

DETAILED DESCRIPTION OF THE INVENTION

Figure 1:
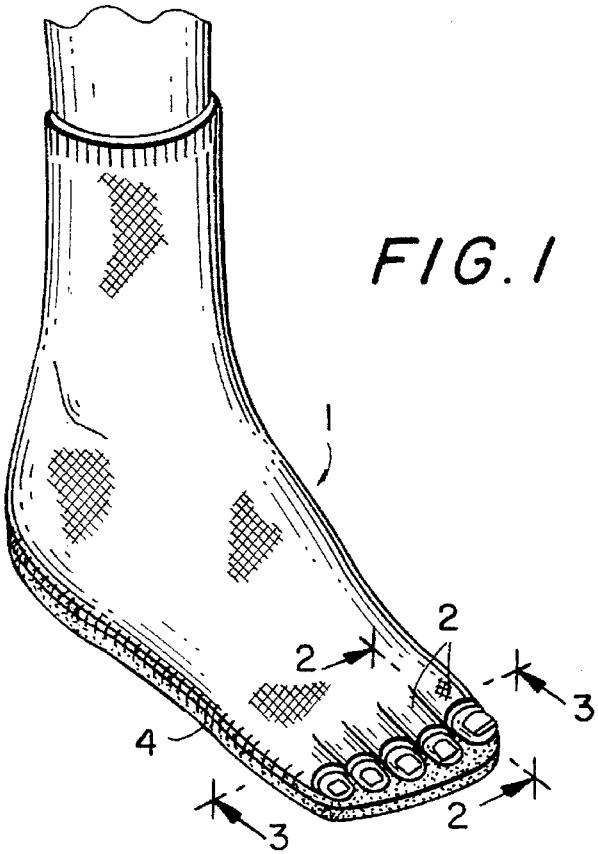
FIG. 1 is a perspective view of a pedicure sock with an optional sole.

Referring to FIG. 1, a pedicure sock 1 has separate stalls 2 for each toe. The sock may be made of any suitable material, including cotton, acrylic, wool, silk, polyester, nylon, cashmere, rayon, NEOPRENE®, etc. and combinations of these materials. Elastic may or may not be added to enhance the ability of the pedicure sock to conform to the shape on which it is placed. The material of which the sock is made can be treated to impart it with a property such that it is water-proof, water-resistant or water-repellant. A product used to treat the material may be, for example, SCOTCHGUARD®. Further, the sock can be made using a water proof material, such as GORETEX®. The materials used to make the pedicure sock can be made of or lined with an insulatory material for added warmth. Such a material which imparts added warmth may be a polyester, such as THINSULATE®. Preferably, the material used to make the sock can keep a wearer's foot warm. Additionally, it is preferable the material used to make the sock is washable and durable.

The pedicure sock can be a conventional sock or stocking and be of any length, such as an anklet, crew, knee-high, thigh-high or can be in the form of panty-hose having two pedicure socks which are attached.

Figure 3:
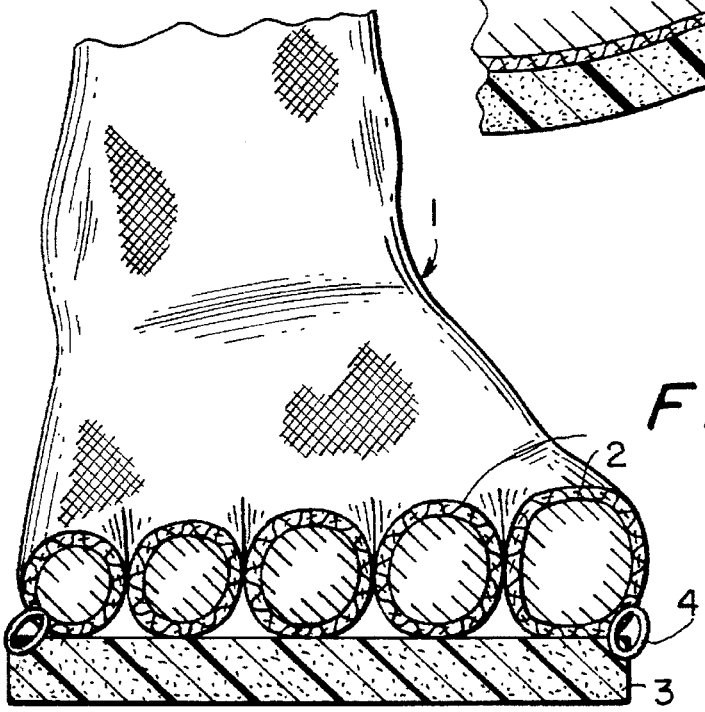
FIG. 3 is a front cross-sectional view of the pedicure sock with the sole of FIG. 1.
Figure 4:
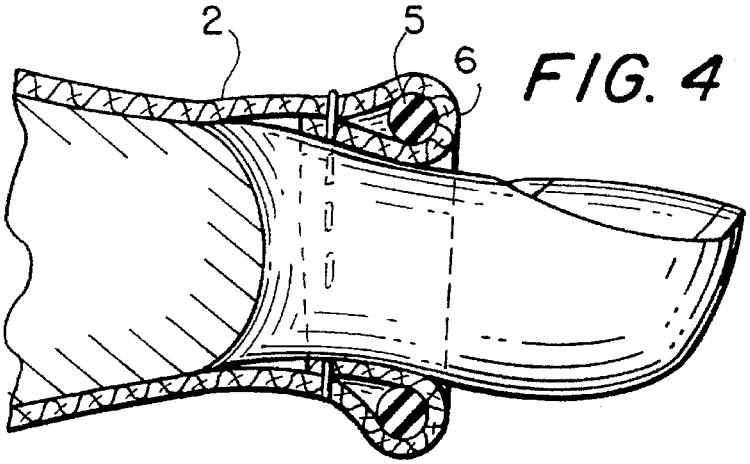
FIG. 4 is a side sectional view of the pedicure sock having an additional optional reinforcement in a top portion of a stall.

The stalls 2 of the pedicure sock 1 are shown as having a circular cross section in FIG. 3. However, the cross section of the stalls 2 can be of virtually any shape, for example, oval, square, rectangular, triangular, etc., as long as they serve to keep the top portion of the toes, where the toe nails are located, separated. Each stall 2 extends from the base of each toe to a portion of each toe underneath the base of each toe's nail so as to prevent the toe nails from touching each other and from touching the pedicure sock, to prevent the freshly applied polish from being marred. Additionally, separating the toe nails makes it easier to perform a pedicure. To improve the fit of the stalls 2 on the toes and enhance the ability of the stalls to separate the tops of the toes, it is preferable to have an elastic band 5 within a fold 6 of each stall 2, as shown in FIG. 4.

Generally, the pedicure sock 1 of the present invention has five stalls 2 corresponding to five toes. However, the pedicure sock 1 can have any number of stalls 2, depending on an individual user's requirements. It is preferable to use stalls to separate the toes. However, it is possible to use strips of material (not shown) between the toes, instead of stalls, to separate the toes, so long as the strips are of a length and width sufficient to separate the tops of the toes where the toe nails are located.

An optional sole 3 may be attached to the pedicure sock 1 to allow the user to walk on any surface without having the bottom of the toes touching the ground. The sole 3 preferably extends along the foot from the rear of the base of the heel to the tips of the toes. It is also possible to extend the material of the sock under each toe to prevent the bottom of the toes from touching the ground. However, it may be preferable to employ a sole 3 for this purpose, since it may be better able to offer support to the wearer and protection from the ground. The sole 3 can be made of any material, for example, paper, rubber, leather, foam, plastic, GORETEX®, a chlorobutadiene, such as NEOPRENE®, etc. It is preferable that the sole 3 is flexible to make it easier to walk on. Additionally, it is preferable that the material of the sole 3 is thick enough to offer protection from the ground. Further, it is preferable that the material of the sole 3 is resistant or impervious to water or other liquids such that the user's feet can avoid contact with such elements. Still further, it is preferable the sole 3 is washable and durable, like the material the sock is made of.

Figure 2:
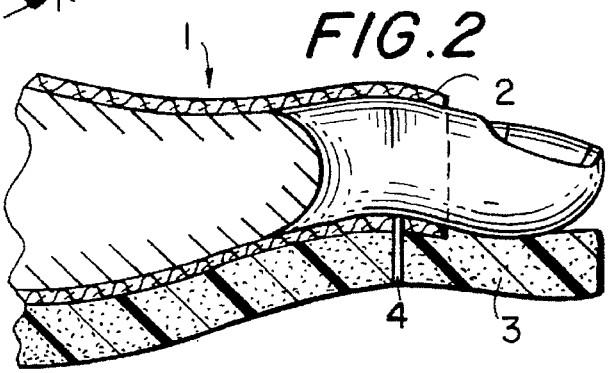
FIG. 2 is a sectional side view of the pedicure sock with the sole of FIG. 1.

The sole 3 can be attached in any manner to the pedicure sock 1. For example, any type of adhesive (not shown) can be used to attach the sock 1 to the sole 3. Further, the pedicure sock 1 and the sole 3 may be stitched together in any manner, such as by stitches 4. The pedicure sock 1 is preferably attached to the sole 3 along its entire length by any type of adhesive (not shown) or by way of stitches 4, as shown in FIG. 2. The stitches 4 can be made in any manner, for example, by hand or by sewing machine. The material used to make the stitches can be of any type, for example, cloth or nylon thread, plastic, etc.

Figure 5:
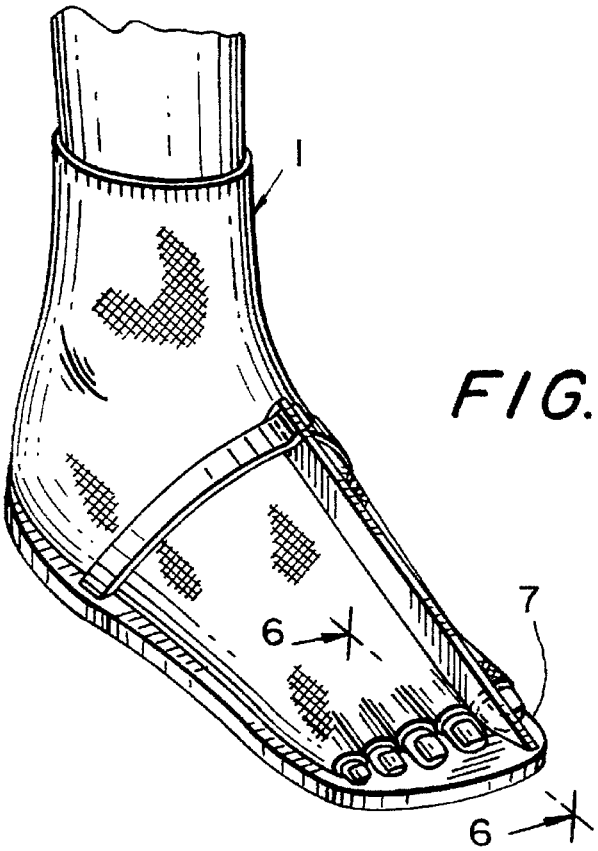
FIG. 5 is a perspective view of the pedicure sock worn with an optional thong or flip-flop-type sandal.
Figure 6:
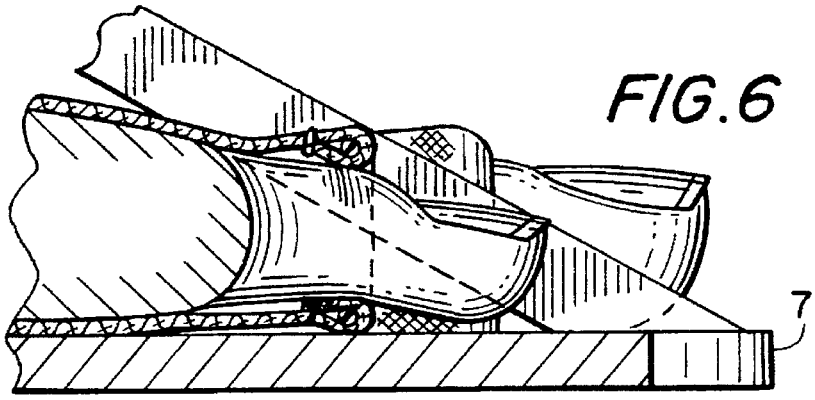
FIG. 6 is a side cross-sectional view of the pedicure sock with the optional sandal of FIG. 5.

As previously stated, the sole 3 is optional and the pedicure sock 1 can be worn alone. When the pedicure sock 1 is worn alone and the user prefers to wear additional footwear, the pedicure sock 1 of the present invention can be used in conjunction with any type of footwear, preferably an open toe sandal which will not mar the fresh polish applied during the pedicure. For example, a thong or flip-flop-type sandal 7 can be worn, such as shown in FIGS. 5 and 6.

As additional protection from the environment, any sole 3 used in conjunction with the pedicure sock 1 of the present invention can have a cover (not shown) over the entire foot or only the toe nail area, vertically supported away from the toe nails so as not to mar the polish. This type of cover can minimize adverse effects of environmental conditions such as rain or snow. The cover can be made of any suitable material such as, for example, plastic or GORETEX®.

As described, the present invention offers advantages over other pedicure devices in that it gives the user the freedom to keep their feet warm before, during and even after a pedicure and, additionally, allows the user the freedom to go outside before the polish applied during their pedicure has cured, without inconvenience, in cooler temperatures.

Having described the present invention with reference to the accompanying drawings, it should be appreciated that the present invention is not limited to the examples described, and that various changes and modifications can be effected therein by one with ordinary skill in the art without departing from the scope of the invention as defined by the appended claims.

What is claimed is:

1. A pedicure device comprising a means for enclosing a foot, said means for enclosing a foot having means for separating toes from each other, said means for separating toes extending from a base of each of the toes, where the toes are connected to each other, to an opening located in an area of each of the toes beneath a base of a toe nail on each of the toes, said means for separating toes having a length sufficient to separate the toes from each other at a portion thereof where the toe nails are located for avoiding damage to polish on the nails.

2. The pedicure device of claim 1, wherein the means for enclosing a foot is hosiery selected from the group consisting of anklets, crews, knee-highs, thigh-highs and pantyhose.

3. The pedicure device of claim 1, wherein the means for enclosing a foot is water resistant, water proof or water repellant.

4. The pedicure device of claim 1, wherein the means for enclosing a foot further comprises a means for insulating.

5. The pedicure device of claim 1, wherein the means for separating toes is a plurality of stalls encircling each toe and terminating at one end thereof in an opening located beneath the base of the toe nail on each of the toes.

6. The pedicure device of claim 5, wherein the pedicure device has five stalls.

7. The pedicure device of claim 5, wherein at least an outer edge portion of the opening in each of said stalls is elastic.

8. The pedicure device of claim 1, further comprising means for preventing the pedicure device from contacting the ground.

9. The pedicure device of claim 8, wherein the means for preventing is a sole.

10. The pedicure device of claim 9, wherein the sole extends along the pedicure device from a rear base portion of a heel of the foot to a front base portion of the toes, such that the sole is underneath the toes.

11. The pedicure device of claim 9, wherein the sole is made of a material selected from the group consisting of paper, rubber, leather, foam, plastic and combinations of these materials.

12. The pedicure device of claim 8, wherein the length of the toe separating means prevents the toe nails from contacting the pedicure device.

13. The pedicure device of claim 8, wherein the toe separating means is of a width sufficient to separate the toe nails from each other.

14. A pedicure device comprising an article of hosiery, the hosiery being formed to fit at least a portion of a foot, the hosiery having a plurality of stalls at one end thereof, each of the stalls being formed to fit at least a portion of each toe, each of the stalls extending from a base of each toe, where the toes are connected, to an opening located in an area of each toe beneath a base of a toe nail on each toe, each of the stalls having a length sufficient to separate the toes from each other at a portion thereof where the toe nails are located for avoiding damage to polish on the nails.

15. The pedicure device of claim 14, wherein the article of hosiery is made of a material selected from the group consisting of cotton, acrylic, wool, silk, polyester, nylon, cashmere, rayon and combinations of these materials.

16. The pedicure device of claim 14, wherein the article of hosiery is selected from the group consisting of anklets, crews, knee-highs, thigh-highs and pantyhose.

17. The pedicure device of claim 14, wherein the article of hosiery is water resistant, water proof or water repellant.

18. The pedicure device of claim 14, wherein the article of hosiery further comprises a means for insulating.

19. The pedicure device of claim 14, wherein the article of hosiery has five stalls.

20. The pedicure device of claim 14, wherein at least an outer edge portion of the opening in each of said stalls is elastic.

21. The pedicure device of claim 14, further comprising means for preventing the pedicure device from contacting the ground.

22. The pedicure device of claim 21, wherein the means for preventing is a sole.

23. The pedicure device of claim 22, wherein the sole extends along the pedicure device from a rear base portion of a heel of the foot to a front base portion of the toes, such that the sole is underneath the toes.

24. The pedicure device of claim 22, wherein the sole is made of a material selected from the group consisting of paper, rubber, leather, foam, plastic and combinations of these materials.

25. The pedicure device of claim 14, wherein the length of each of the stalls prevents the toe nails from contacting the pedicure device.

26. The pedicure device of claim 14, wherein each of the stalls is of a width sufficient to separate the toe nails from each other.

* * * * *